US005405150A

United States Patent [19]

Loder

[11] Patent Number: 5,405,150

[45] Date of Patent: Apr. 11, 1995

[54] QUESTION AND ANSWER BOARD GAME WITH DEFINING, SPELLING AND SYNONYMS

[76] Inventor: Maria A. Loder, 486 Seema Cir., Union City, Calif. 94587

[21] Appl. No.: 270,744

[22] Filed: Jul. 5, 1994

[51] Int. Cl.[6] ..... A63F 3/00; G09B 19/22

[52] U.S. Cl. ..... 273/430; 273/243; 434/128

[58] Field of Search ..... 273/242, 243, 248, 299, 273/302, 429, 430, 431, 432, 272; 434/128, 129, 156, 167, 322

[56] References Cited

U.S. PATENT DOCUMENTS 3,143,348 8/1964 Carsen et al. .
4,306,725 12/1981 Sawyer ..... 273/302
5,251,904 10/1993 Cruz ..... 273/243
5,273,431 12/1993 Charouhas ..... 273/431
5,295,834 3/1994 Saunders ..... 434/128

*Primary Examiner*—Vincent Millin
*Assistant Examiner*—William M. Pierce
*Attorney, Agent, or Firm*—Linval B. Castle

[57] ABSTRACT

An educational game comprising a game board having a closed loop of four legs, each containing eight spaces numbered from 1–4, tokens for each player, a pair of dice, and a plurality of cards, each of which have a word and four numbered statements instructing the player what to do with that word. A player rolls the dice, moves his token into a numbered space and the player to his left reads the card and the instruction having the number corresponding to the number of his space. If the player answers correctly, he takes another turn. The winner is the first player who gets his tokens completely around the loop.

4 Claims, 1 Drawing Sheet

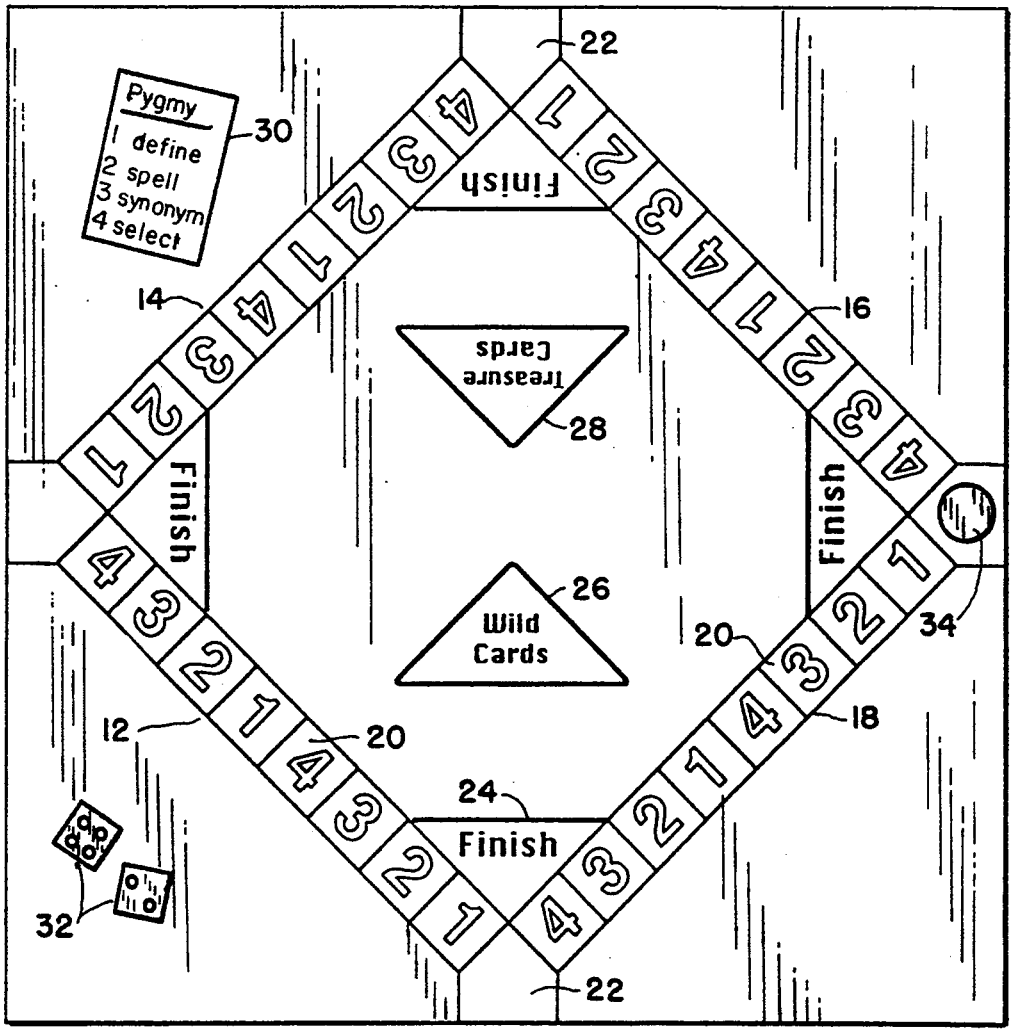
Pygmy
1 define
2 spell
3 synonym
4 select
30
22
14
16
Finish
Finish
Finish
Finish
Treasure Cards
28
Wild Cards
26
20
18
12
20
24
22
34
32

QUESTION AND ANSWER BOARD GAME WITH DEFINING, SPELLING AND SYNONYMS

FIELD OF THE INVENTION

This invention relates generally to games and in particular to a educational board game using a token, two dice and special cards asking for the spelling, definition or the synonym for words on the cards before the token is advanced.

BRIEF SUMMARY OF THE INVENTION

Special question cards are very useful in training and advancing the education of people of all ages. When the cards are part of a game which provides an interest and an incentive to win the game, the combination becomes an educational challenge to the players. One cannot help but learn from such experiences, particularly if it is improving the vocabulary.

The game board of the invention comprises a square board with four printed legs in the form of a closed square with each leg having eight equal size spaces. The spaces are numbered from one to four with two sets of numbers of 1 to 4 on each leg.

A player rolls two dice and moves one of his four tokens, from home base at the junction of two of the legs, to the appropriate space on a leg. The player to his left then reads the next question card from a deck of cards, which has a word written on the top and, beneath the word, are listed four numbered things to do with that word. The player must answer the numbered item corresponding to the number of the space his token occupies. If the player correctly answers the question on the question card, he may again roll the dice. The player who is first to get all four of his tokens around all four legs and into a finish zone is the winner.

The game is educational even for the very young child in kindergarten. A young child would not only practice counting as he moves his token along a leg, but the question cards may contain very simple words, such as cow, horse, pig, cat, or dog and asking the child to spell it, draw it, pronounce it, or make a noise like it. Naturally, as a child advances, so will the complexity of questions on the question cards.

Not only will the game be useful for defining, spelling or finding synonyms for words in everyday vocabularies, but may contain more specialized words such as found in the medical or computer science fields.

BRIEF DESCRIPTION OF THE DRAWINGS

In the drawing which illustrates the preferred embodiment of the invention, the single FIGURE is a plan view illustrating the board used in the game.

DETAILED DESCRIPTION OF THE PREFERRED EMBODIMENT

Illustrated in the drawing is the flat top surface of the game board 10 which has four legs 12,14,16,18, printed in a closed loop forming a square. Each of the legs is divided into eight spaces 20 consecutively and repeatedly numbered clockwise from 1 to 4. Thus, the leg 12 is comprised of the spaces 20 numbered 1,2,3,4,1,2,3,4.

A player's home base 22 is located at the apex or junction of two adjacent legs. A finish zone 24 is also located at the junction of two adjacent legs, but spaced from the home base 22 within the square formed by the four legs. Also within the square formed by the four legs are two zones, one is for Treasure cards 26, the other Wild cards 28.

In addition to the Treasure cards 26 and Wild cards 28, the game requires Question cards 30 and a pair of conventional dice 32. The Question cards 30 contain words followed by four numbered instructions listing something to do with that word. For example a Question card 30 may contain the word, "PSYCHIC" followed by the instructions of 1—spell it; 2—define it; 3—give a synonym; and 4—select from one of the above three instructions. On the rear of the card are typical answers.

The Treasure cards 26 and Wild cards 28 are similar to each other in that they each contain one or more definitions and synomyms of a word ask the player to give the word. For example a Treasure card may give the synonym "to bend the knees, or genuflect" and the planer is supposed to find that this may mean "kneel".

The cards 26, 28, 30 are preferably matched to the skill of the players. That is, if the players are all mature, the above examples may be suitable, but for very young players the cards 26, 28, 30 may refer to easily spelled barnyard animals and the Question card may ask the player to spell it, draw it, pronounce the word, or make a noise like it.

How the game is played

The game is very simple to play but very educational. It is preferably played by from two to four players, however more than four can play as a team. Each player is given four colored tokens 34 which are placed in the home base 22 in front of them. The object of the game is for each player is to move all of his tokens, one at a time, clockwise around all four legs until all arrive in the finish zone 24.

A roll of the dice determines which player is selected to start. He roll the dice and moves one of his tokens 34 clockwise along the leg to his left the number of spaces 20 indicated by the dice. The player to his left then reads a question card 30 and instructs the starting player to perform the card instruction in accordance with the space number of the starting player's token. For example, if the starting player's dice totaled six his token would be on a number "2" space 20, the question card may say "pygmy" and the player at the left would pronounce it ask him to spell it. If the starting player does so correctly, he may then immediately roll the dice and take another turn.

If any player rolls a double, the rules slightly change. If it is a high double (double four, five or six) the player to the left must select a "Wild" card 26 from the, stack of wild cards. If he rolls a low double (double one, two or three) a "Treasure" card 28 is selected. With wild cards 26, a definition is given and the player must give the word. With treasure cards 28, a synonym is given and the player must find the word. For example, a wild card may have the definition: "not wasting money, time, fuel, etc. or thrifty", and the expected answer is "economical". An example of a treasure card may give the synonym "thrust, wound, puncture" and the answer should be "stab".

I claim:

1. An educational game comprising:

a game board having four substantially quadrangular legs printed on said board, each of said legs being divided into eight spaces, said spaces being consecutively and repeatedly numbered from 1 to 4;

at least one token for each player, said token being initially placed at a home base located at a junction of said legs;

a pair of dice; and a plurality of question cards containing a word and four numbered instructions means for explaining what a player is to do with said word, the player to follow the numbered instruction corresponding to the number of the space selected for his token by a roll of the dice.

2. The educational game claimed in claim 1 further including an additional plurality of instructional cards including a first type of card in which a word definition is given and wherein the word is solicited.

3. The educational game claimed in claim 2 further including a second type of instructional card in which a word synonym is given and wherein the word is solicited.

4. An educational game comprising:

a game board having a plurality of legs printed on a surface of said board, said plurality forming a continuous loop, each of said legs being divided into a plurality of numbered spaces;

at least one token for each player;

a plurality of question cards containing a word and a plurality of numbered instructions, a player to follow the instruction having the number corresponding to the number of the space selected for his token by a roll of the dice;

a plurality of synonym cards having the synonym of a word on each card, a player to give that word if his dice display a certain combination; and a plurality of definition cards having the definition of a word on each card, a player to give that word if his dice display a certain combination.

* * * * *